US005643646A

United States Patent [19]

Spence

[11] Patent Number: 5,643,646

[45] Date of Patent: Jul. 1, 1997

[54] TINTED BOTTLES FOR FOOD OR DRUGS

[76] Inventor: David R. Spence, 304 Weston Oaks Ct., Kirkwood, Mo. 63122

[21] Appl. No.: 353,881

[22] Filed: Dec. 12, 1994

Related U.S. Application Data

[62] Division of Ser. No. 104,787, Aug. 11, 1993, abandoned.

[51] Int. Cl.[6] ..... B29D 22/00

[52] U.S. Cl. ..... 428/35.7; 428/409; 206/524.6

[58] Field of Search ..... 428/35.7, 36.4, 428/36.92, 213, 409; 206/524.6; 215/1 C, DIG. 2; 264/DIG. 83, 513; 425/542

[56] References Cited

U.S. PATENT DOCUMENTS

| | | | |
|---|---|---|---|
| 4,102,848 | 7/1978 | Koch et al. | 260/316 |
| 5,035,932 | 7/1991 | Snell et al. | 428/36.4 |
| 5,082,938 | 1/1992 | Kluger et al. | 544/38 |

OTHER PUBLICATIONS

The Plastic Bottle Institute, a Division of The Society of the Plastics Industry, Inc., Technical Bulletin PB1 16 1979, "A Recommended Practice for Measuring 60° Specular Glass of Transparent Plastic Bottles," 3 pages, 1976, New York, NY.

The Plastic Bottle Institute, A Div. of The Society of the Plastics Industry, Inc., Technical Bulletin PB1–19–1979 (Rev. 1–1989), "A Recommended Practice for Visual Evaluation of the Optical Clarity of Transparent Plastic Bottles," 2 pages, 1990, Washington, D.C.

Milliken Chemicals, Cleartint®–Transparent Colorants for Polyolefins, 12 pages, no date but admitted prior art, Spartanburg, S.C.

Solvay Polymers, Information Sheet on Fortiflex® HDPE, 1 page Dec. 1991, Houston, TX.

Exxon Chemical, Information Sheet on Exxon® HDPE–High Density Polyethylene, 2 pages, no date. but admitted prior art.

Quantum Chemical Corp., Information Sheet on Petrothene® LS 9010–46, 1 page, no date, but admitted prior art, Cincinnati, OH.

Du Pont Canada Inc., Specification Sheet on Du Pont 58G, 1 page, Sep. 1991, Missiassauga, Ontario, Canada.

Fina Oil and Chemical Co., Information Sheet on Fina® High Density Polyethylene, 1 page, Dec. 1992, but admitted prior art, Dallas, TX.

*Primary Examiner*—Charles Nold

*Attorney, Agent, or Firm*—Senniger, Powers, Leavitt & Roedel

[57] ABSTRACT

A tinted bottle for food or drugs formed by injection blow molding high density polyethylene in which the walls of the bottle have a thickness between about 0.07 and 0.4 inches, a glossy appearance and contact clarity.

11 Claims, No Drawings

TINTED BOTTLES FOR FOOD OR DRUGS

This is a continuation of application Ser. No. 08/104,787, filed Aug. 11, 1993, now abandoned.

BACKGROUND OF THE INVENTION

The present invention is directed to tinted, high gloss, high density polyethylene bottles having contact clarity, i.e., the walls of the bottle have sufficient clarity such that a product (such as a medicament or vitamin in the form of a tablet or capsule) which is in contact with the inner wall of the bottle can be seen and recognized through the bottle wall.

Bottles used for foods, drugs and vitamins are typically blow molded from a polyvinyl chloride resin which has been colored with a pigment which imparts an amber tint to the bottle. Undesirably, however, these bottles tend to a have dull appearance and are relatively opaque. In addition, these bottles are becoming less desirable because of environmental concerns.

To date, however, the alternatives have been limited. For instance, polystyrene resins provide little or no barrier to oxygen and moisture, polyethylene resins colored with pigments tend to be relatively opaque, and polyethylene terephthalate resins tend to be relatively expensive.

SUMMARY OF THE INVENTION

Among the objects of the present invention, therefore, is the provision of a tinted bottle which is relatively free of environmental concerns; the provision of such a bottle which has a glossy appearance; the provision of such a bottle in which the colorant does not interfere with clarity nor migrate during processing or use; and the provision of such a bottle which is relatively cost competitive with bottles blow molded from resins such as polyvinyl chloride.

Briefly, therefore, the present invention is directed to a tinted, bottle for food or drugs comprising high density polyethylene formed by injection blow molding. The walls of the bottle have a thickness between about 0.07 and 0.4 inches, a glossy appearance and contact clarity.

Other objects will be in part apparent and in part pointed out hereinafter.

DETAILED DESCRIPTION OF THE PREFERRED EMBODIMENTS

The tinted bottles of the present invention typically range in size from about 15 to 1500 cubic centimeters in volume, have a glossy appearance and possess contact clarity. The Plastic Bottle Institute Division of The Society of the Plastics Industry has promulgated Technical Bulletin PBI 16 1979 which sets forth a method for determining the gloss of a plastic bottle. In this method, the test specimen is placed under the receptor window or port of the measurement apparatus and a beam of light from the source lamp is directed at the 60° angle of incidence to the specimen. Using this procedure, the tinted bottles of the present invention should have a specular gloss value of at least about 25, preferably at least about 50, and most preferably at least about 70. The Plastic Bottle Institute Division of The Society of the Plastics Industry has also promulgated Technical Bulletin PBI 19 (Revision 1-1989) which sets forth a testing procedure for determination of the optical clarity of a plastic container. This procedure consists of viewing a calibrated, printed numbered chart through the surfaces of the bottle being evaluated; the optical clarity is designated by the code number of the smallest line of numbers that can be read correctly by a person with normal vision. Using this procedure, the optical clarity should be at least a "6" on the Plastic Bottle Institute Optical Clarity Chart PBI-19, preferably a "5" on this chart, and most preferably a "4" on this chart.

The bottles are injection blow-molded from a mixture containing high gloss, high density polyethylene resin, a slip agent such as zinc stearate or calcium stearate, and a colorant. The mixture preferably contains about 2–6% by weight colorant and about 1–3% slip agent with the balance being high density polyethylene resin.

High density polyethylene resins typically have a density greater than about 0.94 grams/cubic centimeter and a tensile strength at yield of at least about 3,000 pounds per square inch. The high density polyethylene resin is preferably one that has been especially designed for personal care product bottles, imparts high gloss to these bottles and is suitable for injection blow molding. High density polyethylene resin satisfying this criteria is commercially available from a number of sources including, for example, FORTIFLEX HDPE (Product No. F-621F), a high density polyethylene sold by Solvay Polymers, Inc. (Houston, Tex.). PETROTHENE LS 9010-46, a high density polyethylene sold by Quantum Chemical Corporation (Cincinnati, Ohio); HD-9856BF Blow Molding Resin, a high density polyethylene sold by Exxon (Houston, Tex.) and 8183, a high density polyethylene sold by Fina Oil and Chemical Company (Dallas, Tex.). High density polyethylene resin sold by Solvay Polymers, Inc. under the trade designation FORTIFLEX HDPE (F-621F) is particularly preferred.

The colorant should not interfere with the clarity of the bottle and should not migrate during processing and use. Colorants satisfying this criteria are described in U.S. Pat. No. 5,082,938 and U.S. patent application Ser. No. 07/461,852, filed Jan. 8, 1990 (which was incorporated by reference into U.S. Pat. No. 5,082,938) and sold by Milliken Chemical Division of Milliken & Company (Spartanburg, S.C.) under the trade designation CLEARTINT. For use in the preparation of amber-colored vitamin and medicine bottles, colorant sold under the trade designations CLEARTINT PE AMBER 2101, CLEARTINT PE AMBER 2102, CLEARTINT PP AMBER 850 by Milliken Chemical are particularly preferred. The relative proportion of colorant to HDPE resin is solely a function of the desired color.

The high density polyethylene resin, slip agent and colorant should be intimately and thoroughly mixed in the desired proportions, for example, in a weigh blender, a cascade blender or vibratory mixer. Weigh blenders sold under the trade designation WSB-240 by Maguire Products (Media, Pa.) are preferred.

The high density polyethylene resin/slip agent/colorant mixture is fed to a hopper or other feed vessel for the injection blow molding machine. Suitable injection blow molding machines are commercially available from Jomar Corp. (Pleasantville, N.J.), Rainville, Division of Johnson Controls (Manchester, Mich.), Wheaton Industries (Millville, N.J.), and numerous other sources. The mixture is fed from the hopper to the barrell of the blow molding machine and heated therein to a temperature at which the mixture is flowable but not so great as to cause charring or the formation of carbon specks. For example, the temperature is preferably about 380° F. at the inlet end of the barrell and about 500° F. at the outlet end of the barrell and the mixture has a residence time of about 5 minutes in the barrell.

Upon leaving the barrell, the mixture is directed to the nozzle of the injection blow molding apparatus from which it is injected into the cavity of the bottle mold. The pressure at which the mixture is injected ("preform pressure") should be between about 300 and about 600 psi, with a pressure of about 500 psi being preferred. Air, preferably at a pressure of about 120 psi, is then blown into the cavity of the mold to expand the mixture to the desired bottle shape and then quickly cooled.

The mold may be formed from tooled aluminum or steel. To obtain a finished bottle having a high gloss finish, however, it is important that the cavity of the mold have the correct finish. To provide a finished bottle having a high gloss appearance, the cavity wall should have a finish which corresponds to a finish produced on a 420 stainless steel cavity by a buff Grade #3 diamond buff, a Grade No. 6 diamond buff, a Grade #15 diamond buff, 800 grit sandpaper, 400 grit sandpaper, 320 grit sandpaper or 600 stone; these finishes have been designated by the Society of the Plastics Industry as an SPI finish, A-1, A-2, A-3, B-1, B-2, B-3, and C-1, respectively. A finish corresponding to SPI A-1 to B-1 is preferred.

The following example will illustrate the invention.

EXAMPLE

A high gloss high density polyethylene resin sold by Solvay Polymers (Stock No. F-621F), zinc stearate and a colorant sold by Milliken Chemical under the trade designation Cleartint amber PP 850 were mixed in a weigh blender in the proportions of 93 parts, 3 parts, and 4 parts by weight, respectively. The mixture was fed to a Jomar Corp injection blow molding machine and blown into the cavity of a mold having the desired bottle shape. The cavity of the mold had a finish corresponding to an SPI B-1.

The resulting bottles were amber in color, had a high gloss finish (a 60° specular gloss value of at least about 65), and possessed contact clarity (an optical clarity of about 4–5).

As various changes could be made in the above methods without departing from the scope of the invention, it is intended that all matter contained in the above description shall be interpreted as illustrative and not in a limiting sense.

What is claimed is:

1. An injection blow-molded, tinted bottle for holding food or drugs comprising high density polyethylene, the bottle having a wall which has a thickness between about 0.07 and 0.4 inches, a glossy appearance and contact clarity.

2. A tinted bottle for food or drugs comprising high density polyethylene formed by injection blow molding, the walls of the bottle having a thickness between about 0.07 and 0.4 inches, a 60° specular gloss of at least 25 as determined by SPI Technical Bulletin PBI 16 and contact clarity.

3. The tinted bottle of claim 1 wherein the walls have an optical clarity between about 4 and 6 as determined by SPI Technical Bulletin PBI 19.

4. The bottle of claim 2 wherein the walls of the bottle have a specular gloss of at least 50 as determined by SPI Technical Bulletin PBI 16.

5. The bottle of claim 2 wherein the walls of the bottle have an optical clarity between 4 and 5 as determined by SPI Technical Bulletin PBI 19.

6. A tinted bottle for holding food or drugs comprising high density polyethylene formed by injection blow molding in a mold having a cavity wall finish in a range between SPI A-1 to B-1 as designated by the Society of the Plastics Industry, the bottle having a wall which has a thickness between about 0.07 and 0.4 inches, 60° specular gloss of at least 25 as determined by SPI Technical Bulletin PBI 16 (1979) and an optical clarity between about 4 and 6 as determined by SPI Technical Bulletin PBI 19 (revision 1-1989).

7. The bottle of claim 6 wherein the wall has an optical clarity between 4 and 5 as determined by SPI Technical Bulletin PBI 19 (Revision 1-1989).

8. The bottle of claim 6 wherein the wall has an optical clarity of 4 as determined by SPI Technical Bulletin PBI 19 (Revision 1-1989).

9. An injection blow-molded, tinted bottle for holding food or drugs comprising high density polyethylene, the bottle having a wall which has a thickness between about 0.07 and 0.4 inches, a 60° specular gloss of at least 25 as determined by SPI Technical Bulletin PBI 16 (1979), and an optical clarity between about 4 and 6 as determined by Technical Bulletin PBI 19 (Revision 1-1989).

10. The injection blow-molded bottle of claim 1 wherein the bottle has an amber tint.

11. The tinted bottle of claim 6 wherein the bottle has an amber tint.

* * * * *